US010106380B2

(12) United States Patent
Hausladen et al.

(10) Patent No.: US 10,106,380 B2
(45) Date of Patent: Oct. 23, 2018

(54) CABLE WINCH

(71) Applicant: Liebherr-Components Biberach GmbH, Biberach an der Riss (DE)

(72) Inventors: Norbert Hausladen, Biberach (DE); Viktor Schindler, Uttenweiler (DE)

(73) Assignee: Liebherr-Components Biberach GmbH, Bieberach an der Riss (DE)

( * ) Notice: Subject to any disclaimer, the term of this patent is extended or adjusted under 35 U.S.C. 154(b) by 540 days.

(21) Appl. No.: 14/762,721

(22) PCT Filed: Jan. 20, 2014

(86) PCT No.: PCT/EP2014/000139

§ 371 (c)(1),
(2) Date: Nov. 5, 2015

(87) PCT Pub. No.: WO2014/114440

PCT Pub. Date: Jul. 31, 2014

(65) Prior Publication Data

US 2016/0090279 A1 Mar. 31, 2016

(30) Foreign Application Priority Data

Jan. 22, 2013 (DE) ..... 20 2013 000 627 U

(51) Int. Cl.
*B66D 1/14* (2006.01)
*B66D 1/22* (2006.01)
(Continued)

(52) U.S. Cl.
CPC ..... *B66D 1/14* (2013.01); *B63B 27/08* (2013.01); *B66D 1/12* (2013.01); *B66D 1/22* (2013.01);
(Continued)

(58) Field of Classification Search
CPC .. B63B 27/08; B66D 1/14; B66D 1/12; B66D 1/22; B66D 1/28; B66D 5/00; B66D 5/24
See application file for complete search history.

(56) References Cited

U.S. PATENT DOCUMENTS 1,453,559 A * 5/1923 Webb ..... B66D 1/225 254/344
1,476,535 A * 12/1923 Miller ..... B66D 1/12 254/346
(Continued)

FOREIGN PATENT DOCUMENTS

CN 2129758 Y 4/1993
CN 2721597 Y 8/2005
(Continued)

OTHER PUBLICATIONS

ISA European Patent Office, International Search Report and Written Opinion Issued in Application No. PCT/EP2014/000139, dated Mar. 28, 2014, WIPO, 11 pages (Submitted with Translation of Search Report).
(Continued)

*Primary Examiner* — Michael E Gallion
(74) *Attorney, Agent, or Firm* — McCoy Russell LLP

(57) ABSTRACT

The invention relates to a cable winch, preferably a sprocket-type large cable winch for deep-sea applications, having a cable drum, the end faces of which are enclosed by end discs, and having at least one drive unit for driving the cable drum. The drive unit comprises a motor and a gear mechanism which on the output side drives an output wheel, said wheel being in engagement with a drive wheel, preferably in the form of a sprocket, provided on one of the end discs. According to the invention, the output wheel of the drive unit is arranged between motor and gear mechanism,
(Continued)

and the motor and the gear mechanism extend towards different sides of the end disc.

20 Claims, 2 Drawing Sheets

(51) Int. Cl.

| | |
|---|---|
| ***B63B 27/08*** | (2006.01) |
| ***B66D 1/12*** | (2006.01) |
| ***B66D 5/00*** | (2006.01) |
| ***B66D 1/28*** | (2006.01) |
| ***B66D 5/24*** | (2006.01) |

(52) U.S. Cl.
CPC ..... *B66D 1/28* (2013.01); *B66D 5/00* (2013.01); *B66D 5/24* (2013.01)

(56) References Cited

U.S. PATENT DOCUMENTS

| | | | | | |
|---|---|---|---|---|---|
| 2,345,662 | A * | 4/1944 | Fox | B66D 1/26 | 254/340 |
| 2,352,309 | A * | 6/1944 | Benson | B66D 3/02 | 188/82.6 |
| 2,696,366 | A * | 12/1954 | Eskew | B66D 1/26 | 254/298 |
| 3,265,362 | A * | 8/1966 | Moody | B66D 1/14 | 254/343 |
| 3,405,878 | A * | 10/1968 | Lawrence | B66D 1/26 | 254/297 |
| 3,687,249 | A * | 8/1972 | Priest | B66D 1/14 | 192/215 |
| 3,698,690 | A * | 10/1972 | Beaver | B66D 1/08 | 188/69 |
| 3,738,614 | A * | 6/1973 | Peterson | B66D 1/20 | 192/17 R |
| 3,760,654 | A * | 9/1973 | Fisher | F16H 37/00 | 74/410 |
| 3,799,005 | A * | 3/1974 | Koehler | B66D 1/04 | 254/344 |
| 3,917,230 | A * | 11/1975 | Barron | B66D 1/50 | 175/27 |
| 4,004,780 | A * | 1/1977 | Kuzarov | B66D 1/16 | 254/345 |
| 4,073,476 | A * | 2/1978 | Frank | B66D 1/54 | 254/281 |
| 4,098,139 | A * | 7/1978 | Sankey | B66D 1/14 | 74/410 |
| 4,177,973 | A * | 12/1979 | Miller | B66D 1/54 | 188/170 |
| 4,196,889 | A * | 4/1980 | Dudek | B66D 1/22 | 254/344 |
| 4,312,496 | A * | 1/1982 | Norminton | B63B 21/56 | 114/254 |
| 4,426,064 | A * | 1/1984 | Healy | B66D 1/14 | 254/342 |
| 4,478,102 | A * | 10/1984 | Ackermann | C21C 5/50 | 266/245 |
| 4,493,479 | A * | 1/1985 | Clark | B66D 1/58 | 188/134 |
| 5,803,278 | A * | 9/1998 | Shiwaku | B61B 3/02 | 212/274 |
| 6,182,945 | B1 * | 2/2001 | Dyer | B66D 1/54 | 254/340 |
| 7,140,598 | B2 * | 11/2006 | Verakis | B63B 21/22 | 254/345 |
| 7,270,312 | B1 * | 9/2007 | Phipps | B66D 1/22 | 254/278 |
| 7,461,832 | B2 * | 12/2008 | Zhang | B66D 1/14 | 212/274 |
| 7,513,485 | B2 * | 4/2009 | Lee | B66D 1/48 | 254/342 |
| 7,850,147 | B1 * | 12/2010 | Fox | B66D 1/14 | 254/296 |
| 8,616,529 | B2 * | 12/2013 | Kim | B66D 1/50 | 254/335 |
| 8,746,101 | B2 * | 6/2014 | Hausladen | B66C 23/86 | 192/150 |
| 8,820,719 | B2 * | 9/2014 | Ferrari | B66D 1/12 | 254/340 |
| 9,120,655 | B2 * | 9/2015 | Wilkins | B66D 1/225 | |
| 2008/0116432 | A1 | 5/2008 | Folk et al. | | |
| 2010/0065799 | A1 * | 3/2010 | Zhou | B66D 1/22 | 254/344 |
| 2011/0291061 | A1 | 12/2011 | Costas et al. | | |
| 2015/0008381 | A1 * | 1/2015 | Hausladen | B66D 1/30 | 254/288 |
| 2015/0284221 | A1 * | 10/2015 | Hall | B66D 5/02 | 254/342 |
| 2015/0284223 | A1 * | 10/2015 | Hall | B66D 1/38 | 254/333 |
| 2015/0375975 | A1 * | 12/2015 | Flateland | B66D 1/7405 | 254/310 |
| 2017/0305729 | A1 * | 10/2017 | Lautwein | B66D 1/58 | |
| 2017/0362067 | A1 * | 12/2017 | Hiekata | B66D 1/12 | |

FOREIGN PATENT DOCUMENTS

| | | | | |
|---|---|---|---|---|
| CN | 201343400 | Y | 11/2009 | |
| DE | 696076 | C | 9/1940 | |
| DE | 725827 | C | 9/1942 | |
| DE | 1920895 | A1 | 11/1970 | |
| DE | 2117324 | A1 | 10/1971 | |
| DE | 3933505 | A1 | 4/1990 | |
| DE | 19752003 | A1 | 6/1999 | |
| DE | 19919998 | A1 | 11/2000 | |
| DE | 102009035197 | A1 | 2/2011 | |
| EP | 0919512 | A2 | 6/1999 | |
| GB | 103914 | A * | 2/1917 | B66D 1/14 |

OTHER PUBLICATIONS

State Intellectual Property Office of the People's Republic of China, First Office Action Issued in Application No. 201480017451.4, dated Jul. 6, 2016, China, 14 pages.

* cited by examiner

CABLE WINCH

CROSS REFERENCE TO RELATED APPLICATIONS

The present application is a U.S. National Phase of International Patent Application Serial No. PCT/EP2014/000139, entitled "Cable Winch," filed on Jan. 20, 2014, which claims priority to German Utility Model Patent Application No. 20 2013 000 627.7, filed on Jan. 22, 2013, the entire contents of each of which are hereby incorporated by reference in their entirety for all purposes.

TECHNICAL FIELD

The present invention relates to a cable winch, preferably a sprocket-type large cable winch for deep-sea applications, having a cable drum, the end faces of which are enclosed by end discs, and having at least one drive unit for driving the cable drum, the drive unit comprising a motor and a gear mechanism which on the output side drives an output wheel, said wheel being in engagement with a drive wheel, preferably in the form of a sprocket provided on one of the end discs.

BACKGROUND AND SUMMARY

With cable winches for large cable lengths it is difficult to wind-up the great amount of cable or the large length of cable onto the cable drum correctly while designing the cable winch with compact dimensions. Large-scale cable winches for deep-sea applications frequently require cable lengths exceeding 1000 m or even several thousand meters to be able to lower the load hook to a sufficient depth below the water surface. In order to control the winding proportions on the drum as desired, a long cable drum is preferable, which makes the cable winch rather bulky, however. As a result, the cable winch will be quite wide, which may exceed the desired maximum crane width or will require an excessively large envelope circle when rotating the crane to prevent collisions.

To alleviate such excessive widths and the problems resulting from collisions, it had already been proposed to simply shorten the length of the cable drum accordingly so as to have a cable drum design with narrower dimensions overall. With long cable lengths, however, several cable layers have to be wound on top of each other, which has the disadvantage that the winding operation can no longer be controlled, producing a very large winding diameter, because more cable layers must be wound on top of each other. This larger winding diameter results in greater output torques and at the same time also in greater loads on the end discs, because the wound-up cable layers support themselves laterally against the end disc.

The excessive width problem with such large-scale winches, which have a sufficient cable drum length to lessen the aforementioned winding problems, is also aggravated by the fact that drive assemblies are normally configured to be arranged on the outside, which frequently project considerably beyond the end discs and even still beyond the bearing shields on which the cable drum is pivoted.

It had in fact already been considered to incorporate the drive unit inside of the cable drum. But this has various drawbacks compared to an external configuration of the drive assemblies, such as with respect to installation and ease of maintenance as well as torque transmission. With large-scale winches of the cited kind it is advantageous to arrange the drive assemblies outside of the cable drum in the vicinity of the periphery of the end discs of the cable drum, wherein in particular a sprocket connected with the aforementioned end discs or which is formed by the end discs themselves can be used, which sprocket is in engagement with an output wheel of the drive assemblies. In this manner, the drive forces or the drive moment can be controlled precisely, wherein the rotational speed of the output wheel of the drive unit can be geared down once more with respect to the cable drum by appropriate diameter ratios, achieving a high level regarding ease of assembly and maintenance.

Frequently, a large axial projection of the drive assemblies results with such sprocket-type large scale cable winches, because in addition to the motor itself, the drive assemblies sometimes require a reduction gear having quite a long design to be able to convert the drive speed of the motor as desired.

The object of the present invention is to provide an improved cable winch of the cited kind, which avoids the disadvantages of the prior art and develops the latter in an advantageous manner. In particular, a cable winch with an external drive and which can be assembled and maintained easily is to be provided, which can be constructed with sufficient cable drum length despite the favorable winding proportions and which does not have excessive width to impede the crane's range of motion.

According to the present invention, the aforementioned problem is solved by a cable winch as cited in claim 1. Preferred embodiments of the invention are the subject of the dependent claims.

To utilize the available installation space on the cable drum, it is proposed to split-up the motor and the gear mechanism of the at least one drive unit onto different sides of an end disc of the cable drum. According to the present invention it is envisaged that the output wheel of the drive unit is arranged between motor and gear mechanism and that the motor and the gear mechanism extend towards different sides of the end disc. Because of the split-up configuration of motor and gear mechanism onto different sides of the respective end disc of the cable drum, it is possible to prevent an excessive projection of the drive unit beyond the front end of the cable drum on the one hand, while on the other any collision problems in the space between the end discs because of an optional additional drive unit or other components, is prevented. The available installation space between the end discs is utilized optimally, while at the same time it is possible to obtain good accessibility both to the motor as well as to the gear mechanism and therefore a high level regarding ease of assembly and maintenance.

In developing the present invention, it may have been implemented in the arrangement of the at least one drive unit such that the motor and the gear mechanism of the drive unit extend to opposite sides of a bearing shield, on which the cable drum is pivoted and on which the drive unit can be supported or mounted.

For this purpose, the split-up of motor and gear mechanism relative to the sides of the return discs and/or sides of the bearing shield can in principle be implemented differently. The gear mechanism can extend towards the outside of the end disc of the cable drum and/or of the outside of the bearing shield, for example, while the motor extends towards the inside of the end discs and/or the inside of the bearing shield. In developing the present invention, it is also possible that the gear mechanism can extend towards the inside of the bearing shield or the inside of the end disc, however, while the motor is arranged on the outside of the end shield or bearing shield. The latter configuration is particularly advantageous, if the gear mechanism assembly extends longer axially than the motor, so that the axial projection of the drive unit beyond the cable drum or the bearing shields is particularly small and the installation space between the end shields of the cable drum is utilized optimally. The energy supply of the motor can moreover be ensured in a particularly simple manner, if the motor is arranged on the outside of the end discs or of the bearing shield, for example by means of energy supply lines laid along the bearing shield.

In principle, the motor can be designed differently, for example an electric motor that is supplied via an electrical line or a hydraulic motor that is supplied via a pressurized fluid line.

In order to be able to arrange the output wheel of the drive unit compact between motor and gear mechanism without wasting radial installation space, the output wheel can be formed advantageously as hollow component and have an opening recess, through which a drive shaft extends that can be rotated relative to the output wheel, which drive shaft connects the motor on the one side of the output wheel with the gear mechanism on the other side of the output wheel. Advantageously, for this purpose the aforementioned drive shaft can essentially extend through the entire gear mechanism unit and be connected with an input element of the gear mechanism, which input element is arranged on an end section of the gear mechanism facing away from the output wheel or from the motor.

The aforementioned output wheel and/or the drive shaft which extends through the output wheel can be advantageously arranged approximately coaxially to the main axis of the drive unit, particularly approximately coaxial to a motor shaft and/or a main axis of the gear mechanism. A radially offset configuration would also be possible as an option, but wherein for attaining a slender design of the drive unit, a coaxial configuration of the output wheel and of the drive shaft extending through it is advantageous.

The drive moment originating from the motor is advantageously fed into the gear mechanism on a side of the gear mechanism facing away from the motor. As a result, a brake can be easily integrated into the drive unit, which, based upon the captured forces, can advantageously engage a gear or drive element onto which a relatively small, particularly the smallest occurring torque, is applied. The brake can in particular be able to be coupled to the aforementioned drive shaft or to the input element of the gear mechanism connected therewith, to be able to decelerate the cable drum geared-down appropriately utilizing the gear stage, so that a drum element induced by the pull of the cable only acts on the brake or has to be captured by it.

Advantageously, the aforementioned brake can be arranged on the front side of the gear mechanism unit facing away from the motor, as a result of which the brake is well accessible from outside and can be easily serviced, or assembled and dismantled.

If the brake is applied, the motor can also be demounted for maintenance or in case of emergency, although a load (torque) may have still be applied on the cable winch.

In developing the present invention, the drive unit can have a modular design, wherein a first assembly is formed from the gear mechanism, on the front side of said assembly a second assembly formed by the motor is mounted detachably and/or on the second front side of which a third module formed by the brake is mounted detachably. In particular, the motor, the gear mechanism and the brake can form three block-like assemblies, which are essentially arranged sequentially coaxial reciprocal, wherein particularly the gear mechanism can be arranged between motor and brake.

In developing the present invention, a detachable connection transmitting the torque can be provided preferably in the form of a plug-in connection between the drive shaft extending through the drive wheel of the drive unit, on the one hand, and the motor on the other and/or between the aforementioned drive shaft and the brake in each case, so that motor and/or gear mechanism can be dismantled easily and the drive shaft can remain as a fixed constituent part of the gear mechanism unit and/or in the gear mechanism, even when the motor or the brake are detached. The plug-in connection can be designed axially detachable, i.e. in the longitudinal direction of the shaft.

The aforementioned plug-in connection can in principle be designed differently, for example in the form of a spline-shaft hub profile or a polygon shaft boss joint.

The gear mechanism of the drive unit can have different variants. To facilitate the previously described arrangement of the output wheel between motor and gear mechanism and the transfer of the motor moment via the output wheel to the gear mechanism unit, in particular by means of the aforementioned penetrating long drive shaft, the gear mechanism can be designed as planetary gearing, preferably in form of a multistage planetary gearing configuration, the input element of which can be connected with the aforementioned, motor-linked drive shaft and the output element of which can be coupled with the output wheel of the drive unit. In this context, different planetary stage elements can be selected as input elements and output elements, depending on the desired gear ratio. To be able to realize a high step-down or step-up ratio in a space-saving configuration, depending on the viewing direction, in an advantageous refinement of the present invention, the sun gear of a first planetary stage can be connected with the motor-linked drive shaft and/or the output wheel of the drive unit can be coupled with a second or further planetary stage.

If multiple planetary stages are provided, they can be reciprocally coupled in different ways. The planet carrier of a first planetary stage can be coupled with the sun gear of a secondary planetary stage, for example, wherein the ring gears of both planetary stages can be fixed on the gear case. Other configurations are possible in principle, however, depending on the desired gear ratio.

In developing the present invention, in that context all stages of the planetary gear can be arranged on the same side of the output wheel of the drive unit. In an alternative development of the present invention, the gear mechanism can be also designed such, however, that the output wheel of the drive unit is arranged axially between two stages of the planetary gear.

The transmission of force or torque from the output wheel to the drive unit onto the cable drum or the drive wheel connected therewith can in principle be done in different ways, for example frictional, by a pair of friction wheels revolving together or a transmission belt stage, however by means of a positive joint, which in particular can be accomplished by a meshing gear pair or optionally by a chain drive.

In particular, the output wheel of the drive unit and a drive wheel coupled with the cable drum are forming a sprocket stage, which can advantageously be in engagement.

The aforementioned drive wheel connected with the cable drum can be integrated into one of the end discs of the cable drum, for example by a tooth profile on the outer perimeter of the end disc. The aforementioned drive wheel will advantageously be designed as sprocket which can be rigidly attached onto one of the end discs of the cable drum. In principle, however, the aforementioned drive wheel can also be designed separately from the end disc and be connected with the cable drum body in a different manner, for example by a direct connection with the drum body or by attachment onto a drum flange.

In developing the present invention, the drive unit can be arranged radially outside of the cable drum, in particular in the area of the outer perimeter of the end discs of the cable drum and can extend through a bearing shield arranged adjacently to the respective end disc or extend beyond the aforementioned bearing shield. The aforementioned bearing shield can have a bearing recess, into which the drive unit can be arranged or installed.

In the following, the present invention is explained in detail, using preferred embodiments and associated figures.

DETAILED DESCRIPTION

Figure 1:
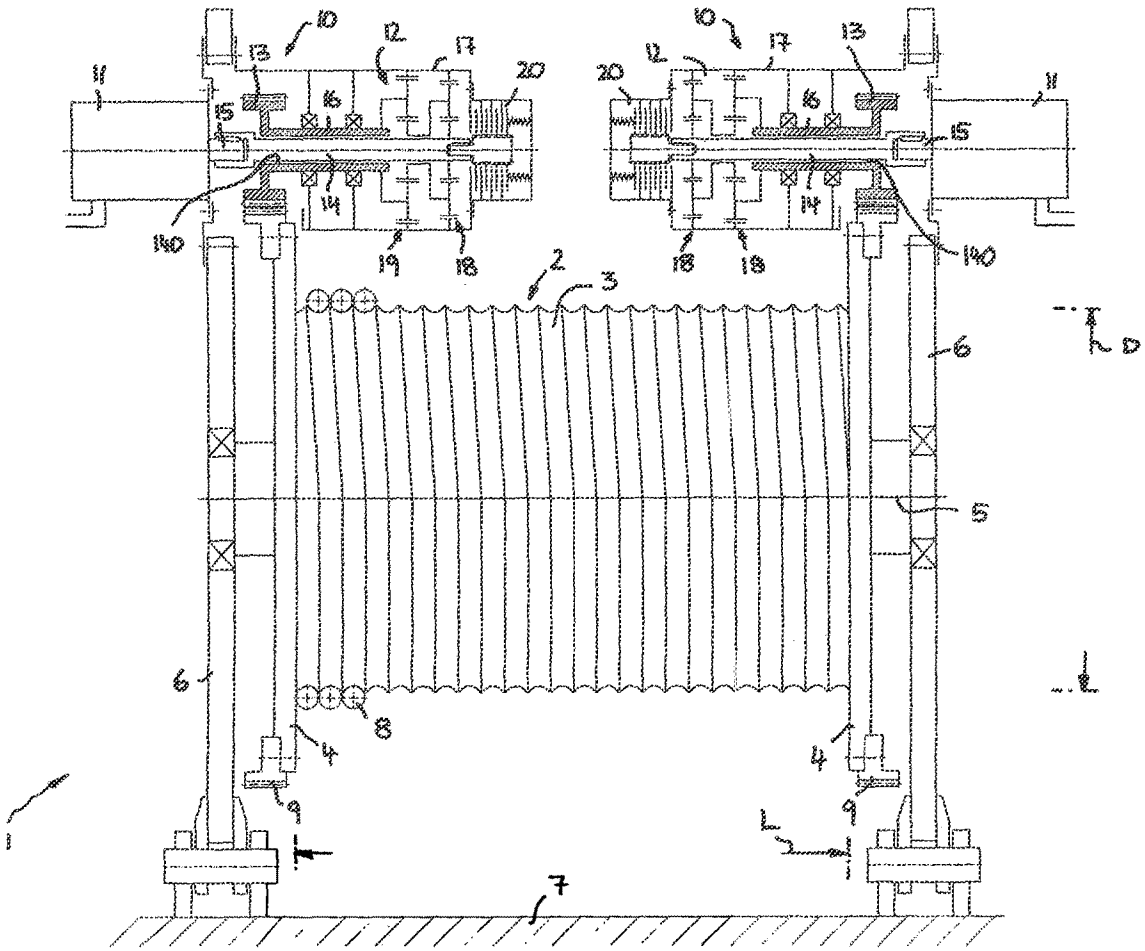
FIG. 1 shows a schematic lateral view with a cable winch according to an advantageous embodiment of the present invention, with a sectional representation of the drive assemblies, which extend with the gear mechanism on the inside of the shield and with the motor on the outside of the shield.

As shown in FIG. 1, the cable winch 1 can have a cable drum 2 with an essentially cylindrical drum body 3 and end discs 4 enclosing the front ends of the drum body 3, which end discs 4 extend essentially perpendicular to the longitudinal axis of the cable drum 2. The aforementioned cable drum 2 is pivoted about its longitudinal axis 5 on two bearing shields 6, which also extend essentially perpendicular to longitudinal axis 5 of the cable drum 2 and are supported on a cable winch base 7 in an actually known manner. The aforementioned cable winch base 7 can be a chassis part of a rotatable crane turret platform, for example, in particular of an offshore crane with a boom across which a hoisting cable runs.

In this context, the aforementioned hoisting cable 8 can be very long, to be suitable for deep-sea applications or suchlike. To be able to manage winding-up such long hoisting cable 8 using reasonable winding proportions, the cable drum 2 can be developed to be relatively long, wherein a length/diameter ratio L/D of the drum body 2, see FIG. 1, can be in the range of approximately 1 to 2, wherein the cable drum 2 diameter can be in the range of several meters, for example. But also other dimensions or dimensional ratios can be selected and be advantageous, depending upon the application.

In order to be able to drive the cable drum 2 rotationally, drive wheels 9 can be provided on the end discs 4 of the cable drum 2, particularly in the area of the outer perimeter of the aforementioned end discs 4, which drive wheels can be attached rigidly onto the cable drum 2, for example rigidly onto the end discs 4. The aforementioned drive wheels 9 can be designed particularly as sprockets with an external toothing.

The aforementioned drive wheels 9 and thus the cable drum 2 are driven using drive assemblies 10, which are arranged in the area of the outer perimeter of the end discs 4 and which can be supported on the bearing shields 6. In the embodiment shown in the drawing, two drive assemblies 10 are provided right and left, so that each of the end discs 4 can be driven. In principle, it would however also be possible to drive only one end disc, or conversely to provide more than two drive assemblies, for example in such a way that each end disc is driven by two drive assemblies 10, for example.

As FIG. 1 illustrates, each of the drive assemblies 10 has a motor 11 as well as a gear mechanism 12, the input side of which is driven by the aforementioned motor 11 and which from the output side drives an output wheel 13, which forms a pair of spur gears with the drive gear provided on the end disc 4, and which can particularly be in engagement with the aforementioned sprocket.

The aforementioned motor 11 and the gear mechanism 12 can be arranged consecutively coaxial, in particular such that a main axis of the drive unit 10 essentially extends parallel to the longitudinal axis 5 of the cable drum 2, wherein the motor 11 and/or a drive shaft 14 extending through the gear mechanism 12 can define the aforementioned main axis of the drive unit.

The output wheel 13 driving the end discs 4 of the cable drum 2 of the respective drive unit 10 for this purpose is arranged between the motor 11 and the gear mechanism 12 and/or is provided in a central section of the drive unit 10, so that the motor 11 or at least a part of the motor 11 on the one side of the output wheel 13 and the gear mechanism 12 or at least a part of the gear mechanism 12 extends to the opposite side of the output wheel 13.

To be able to configure the position of the output wheel 13 in a simple manner between motor 11 and gear mechanism 12 without wasting large radial installation space, the aforementioned output wheel 13 is designed as a hollow component and has an opening recess 140, through which a drive shaft 14 extends, which is connected torque-proof with the motor 11 or a motor output shaft 15 on the one side of the output wheel 13, and on the other side of the output wheel 13 is coupled onto an input element of the gear mechanism 12. For this purpose, the aforementioned drive shaft 14 extends through the output wheel 13 so that it is rotatable, i.e. the output wheel 13 can be rotated with respect to the aforementioned drive shaft 14. As FIG. 1 illustrates, the output wheel 13 can include a wavelike, longitudinal bearing section 16 that is provided with the aforementioned opening recess 140 and extends coaxial to the drive shaft 14. The output wheel 13 is advantageously pivoted on the casing 17 of the gear mechanism 12 by means of one or multiple roller bearings. Alternatively or in addition, a rotational bearing or a rotational pivoted support can also be provided between the output wheel 13 and the drive shaft 14.

In an advantageous refinement of the present invention, the gear mechanism 12 can be designed as planetary gearing, which, as shown in FIG. 1, can include multiple planetary stages 18 and 19.

Advantageously, the drive shaft 14 connecting the motor 11 with the gear mechanism 12 extends essentially through the entire gear mechanism 12 and is connected with an input element of the first planetary stage 18 which is arranged in an end section of the gear mechanism 12 facing away from the motor 11. As FIG. 1 illustrates, the drive shaft 14 can be connected torque-proof with a sun gear of the aforementioned first planetary stage 18, wherein an internal gear of the aforementioned planetary stage 18 is supported torque-proof on casing 17 and the planet carrier of this planetary stage can be coupled with an input element of the second planetary stage 19, in particular with its sun gear. Even in this second planetary stage 19, the ring gear can be fixed on the gear casing 17, wherein the planet carrier of the second planetary stage 19 can be coupled torque-proof with the output wheel 13.

A brake 20 can be provided on the front side of the gear mechanism 12 facing away from the motor 11. As FIG. 1 illustrates, the brake 20 can be fastened detachably on gear casing 17 and act on the above-mentioned drive shaft 14 and/or on the input element of the planetary gear connected therewith, in order to be able to decelerate the drive unit 10 or the cable drum 2. For this purpose, the brake 20 engages advantageously on the drive element, on which the lowest torsional moment is applied as a result of utilizing the gear ratio. A torsional moment induced from hoisting cable 8 into the cable drum 2 will be considerably reduced by the gear mechanism 12, for example, before it must be captured by the brake 20.

The brake 20 can be designed differently, for example in form of a multiple disc brake, which is developed spring-loaded into the braking position and which can be lifted hydraulically or electrically.

Figure 2:
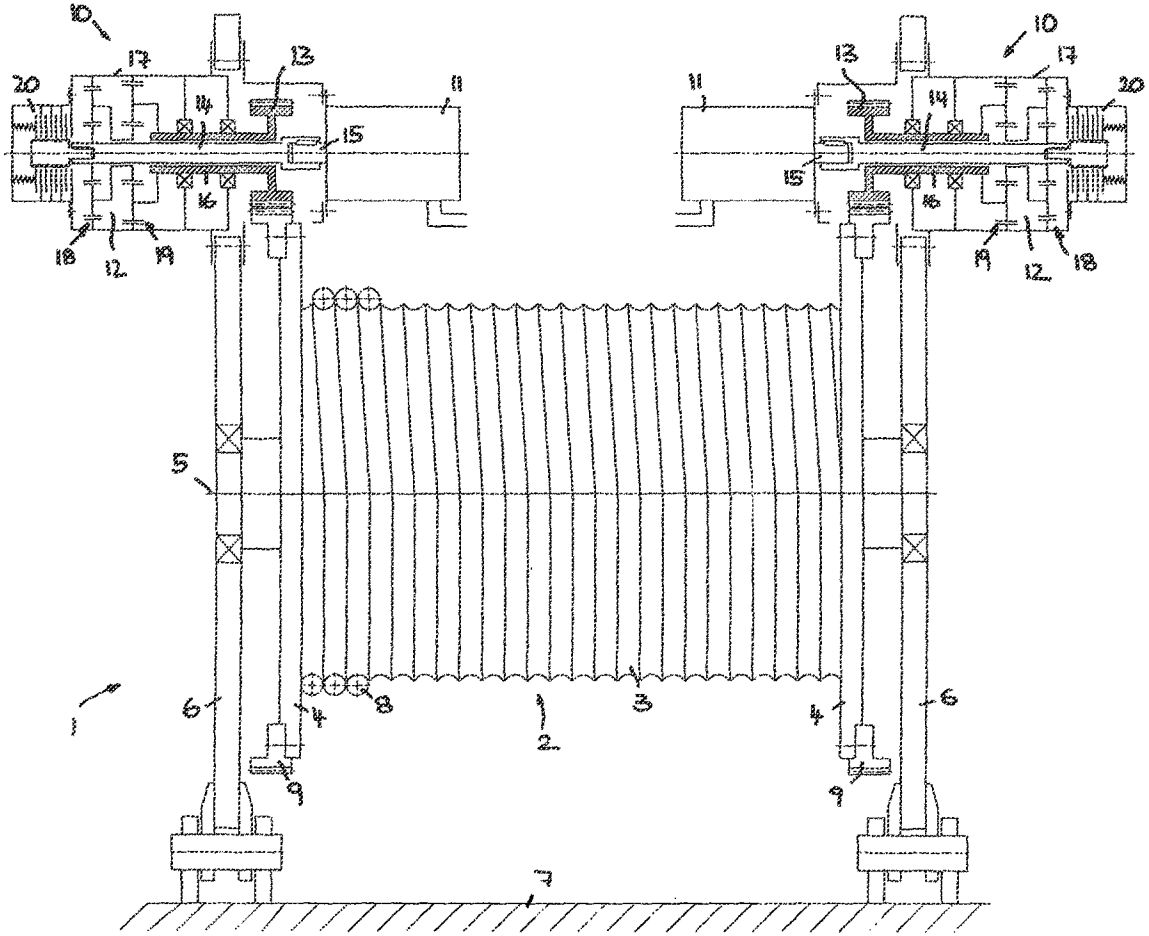
FIG. 2 shows a schematic lateral view of a cable winch according to a further embodiment of the present invention, with a partial sectional representation of the drive assemblies, which extend with the motor on the inside of the shield and with the gear mechanism on the outside of the shield.

The embodiment of the cable winch illustrated in FIG. 2 corresponds largely to the design according to FIG. 1, so that insofar as it is permissible, the preceding description is referred to and the same reference symbols are used. Compared to the embodiment according to FIG. 1, the embodiment according to FIG. 2 is essentially different in that the installation of the drive assemblies 10 is reversed, i.e., the motors 11 of both drive assemblies 10 are arranged on the inside and the gear mechanisms 12 on the outside, while in FIG. 1, the gear mechanisms are arranged inside and the motors outside; compare FIG. 1 and FIG. 2 to one another.

The invention claimed is:

1. A cable winch comprising a cable drum, end faces of which are enclosed by end discs, and at least one drive unit for driving the cable drum, wherein the drive unit comprises a motor, a gear mechanism, and a drive shaft that connects the motor with the gear mechanism, where an output side of the gear mechanism drives an output wheel, and where an input side of the gear mechanism is driven by the motor, said output wheel being in engagement with a drive wheel in the form of a sprocket provided on one end disc of the end discs, wherein the output wheel of the drive unit is arranged between the motor and the gear mechanism, in a direction of a longitudinal axis of the cable drum, and the motor and the gear mechanism of the drive unit extend toward different sides of the end disc, relative to the longitudinal axis; wherein the motor, the gear mechanism, and the output wheel are coaxial.

2. The cable winch as cited in claim 1, wherein the drive unit is attached on a first bearing shield of two bearing shields on which the cable drum is pivoted, on one side of the cable drum, wherein the motor and the gear mechanism of the drive unit extend towards and are arranged on opposite sides of the first bearing shield.

3. The cable winch as cited in claim 1, wherein the output wheel of the drive unit is formed as a hollow component and has an opening recess, through which the drive shaft which rotates through the drive unit extends, which connects the motor with the gear mechanism and wherein the output wheel is coupled to an outer face of the drive wheel.

4. The cable winch as cited in claim 3, wherein the drive shaft is coupled torque-proof with a first planetary stage that is arranged in an end section of the gear mechanism facing away from the motor.

5. The cable winch as cited in claim 1, wherein the gear mechanism is developed as planetary gearing, with a first planetary stage, including an input element, of said planetary gearing connected with the drive shaft coupled with the motor, and with a second planetary stage of said planetary gearing coupled with the output wheel of the drive unit.

6. The cable winch as cited in claim 1, wherein the motor and the gear mechanism of the drive unit are positioned above the end disc with respect to a base which the cable winch is supported on and wherein the motor and the gear mechanism are arranged on a same side of the cable drum relative to the longitudinal axis.

7. The cable winch as cited in claim 5, wherein all planetary gear stages are arranged on a same side of the output wheel of the drive unit.

8. The cable winch as cited in claim 1, wherein the drive unit includes a brake which is coupled with an input element of the gear mechanism and/or with the drive shaft connected with said gear mechanism linked with the motor and wherein the brake is arranged on a side of the gear mechanism opposite of the motor.

9. The cable winch as cited in claim 8, wherein the brake attaches onto the drive shaft, onto which, because of a gear mechanism step-up/step-down ratio, a lowest torsional moment of the drive unit is applied.

10. The cable winch as cited in claim 8, wherein the drive unit has a modular design, wherein a first assembly is formed from the gear mechanism, on a front side of which assembly a second assembly formed by the motor is mounted detachably and/or on a second front side of which a third module formed by the brake is mounted detachably.

11. The cable winch as cited in claim 8, wherein between the drive shaft extending through the output wheel and the motor and/or between the drive shaft extending through the output wheel and the brake a detachable connection transmitting torque is provided.

12. The cable winch as cited in claim 8, wherein the motor, the gear mechanism, and the brake are arranged consecutively, coaxial with reference to a main axis of the drive unit, wherein the gear mechanism is arranged between the motor and the brake.

13. The cable winch as cited in claim 1, wherein the output wheel of the drive unit and the drive wheel provided on one of the end discs form a spur gear stage and wherein the drive wheel is provided on an outer perimeter of one of the end discs.

14. The cable winch as cited in claim 1, wherein the drive unit is arranged in an area of an outer perimeter of the end disc and/or outside of a cable drum perimeter of the cable drum and extends with a drive unit main axis approximately parallel to the longitudinal axis and wherein the drive unit main axis is a common axis of each of the motor, the gear mechanism, and the output wheel.

15. The cable winch as cited in claim 1, wherein the one end disc is arranged on an opposite side of the cable drum from another end disc of the end discs, and wherein the drive unit extends on both sides of a plane defined from the one end disc as well as also on both sides of a plane defined from a first bearing shield of two bearing shields of the cable winch, the first bearing shield arranged on a same side of the cable drum as the one end disc.

16. The cable winch as cited in claim 1, wherein the at least one drive unit is a first drive unit that drives a first end disc of the end discs, where the output wheel of the first drive unit is in engagement with the drive wheel in the form of the sprocket provided on the first end disc of the end discs, and further comprising:

a second drive unit that drives a second end disc of the end discs, wherein the second drive unit comprises a motor, a gear mechanism, and a drive shaft that connects the motor with the gear mechanism, where an output side of the gear mechanism of the second drive unit drives an output wheel, and where an input side of the gear mechanism of the second drive unit is driven by the motor of the second drive unit, said output wheel being in engagement with a drive wheel in the form of a sprocket provided on the second end disc of the end discs, wherein the output wheel of the second drive unit is arranged between the motor and the gear mechanism of the second drive unit, in a direction of a longitudinal axis of the cable drum, and the motor and the gear mechanism of the second drive unit extend toward different sides of the second end disc, relative to the longitudinal axis, wherein the first and second drive units allocated to different end discs are arranged reciprocally oriented such that either the motors of both the first and second drive units are arranged on an inside and the gear mechanisms of both the first and second drive units are arranged on an outside, or the gear mechanisms of both the first and second drive units are arranged on the inside and the motors of both the first and second drive units are arranged on the outside.

17. The cable winch as cited in claim 1, wherein a hoisting cable that is wound-up on the cable drum has a length of more than 1000 m and/or the cable drum has a length/diameter ratio L/D>1 and/or the cable drum has a diameter (D)>2 m.

18. The cable winch as cited in claim 1, wherein the cable winch is a sprocket-type large cable winch for deep-sea applications.

19. The cable winch as cited in claim 15, wherein the motor is arranged on an outside of the first bearing shield and the gear mechanism is arranged on an inside of the first bearing shield.

20. The cable winch as cited in claim 15, wherein the motor is arranged on an inside of the first bearing shield and the gear mechanism is arranged on an outside of the first bearing shield.

* * * * *